United States Patent [19]

Bryan et al.

[11] Patent Number: 4,922,888

[45] Date of Patent: May 8, 1990

[54] PROTECTIVE COVERING DEVICE

[76] Inventors: Deborah M. Bryan; Randall W. Bryan, both of 3614 Lincoln, Dearborn, Mich. 48124

[21] Appl. No.: 274,450

[22] Filed: Nov. 21, 1988

[51] Int. Cl.[5] ..... F24C 3/12

[52] U.S. Cl. ..... 126/42

[58] Field of Search ..... 126/24, 42, 211, 212, 126/214 D, 214 R; 431/158

[56] References Cited

U.S. PATENT DOCUMENTS

| | | | |
|---|---|---|---|
| 928,770 | 7/1909 | Knudsen | 126/42 |
| 1,021,034 | 3/1912 | Zadig et al. | 126/42 |
| 1,146,613 | 7/1915 | Rosa | 126/42 |
| 1,271,539 | 7/1918 | Cadigan | 126/42 |
| 1,329,490 | 2/1920 | Worthington | 126/42 |
| 2,764,968 | 10/1956 | Shuster | 126/42 |
| 4,134,386 | 1/1979 | Miguel | 126/42 |

FOREIGN PATENT DOCUMENTS

| | | | |
|---|---|---|---|
| 1176049 | 4/1959 | France | 126/42 |

*Primary Examiner*—James C. Yeung

[57] ABSTRACT

A protective device (10) useful with an appliance (12) such as a stove or an oven having at least one control knob (14) operatively positioned on a first surface of the appliance, the device (10) comprising: a cover (20), movable between a first position and a second position, for protectively enveloping the control knob when in the first position and for permitting access to the control knob when in the second position; and magnetic material (60) attached to a portion of the cover (20) for causing the first means to tend to be maintained in the first position.

12 Claims, 1 Drawing Sheet

FIG. 1
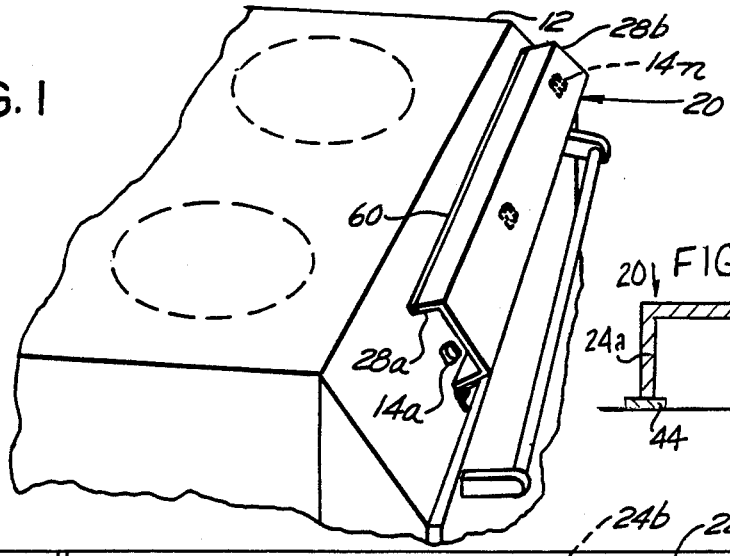
FIG. 5
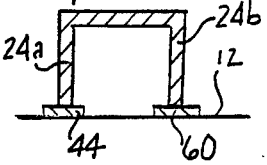
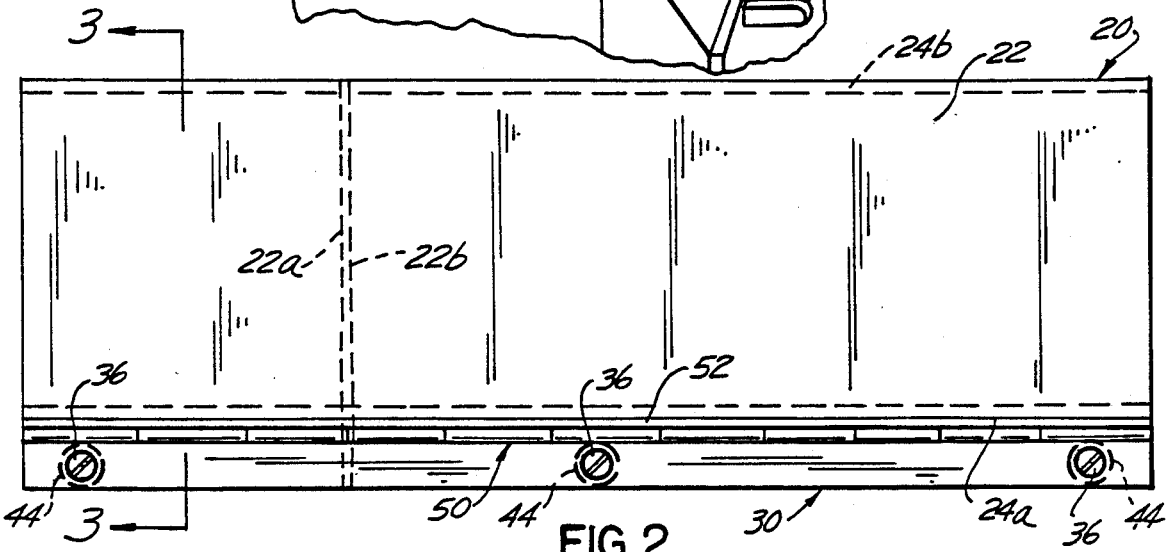
FIG. 2
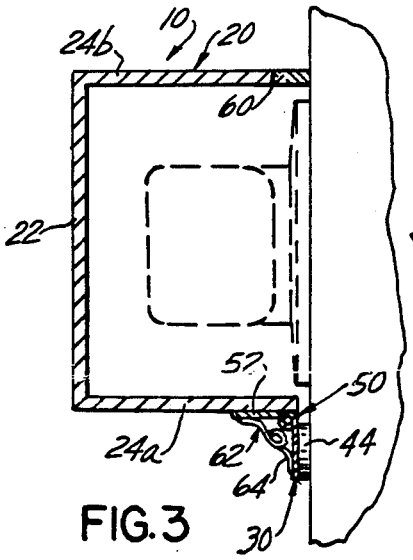
FIG. 3
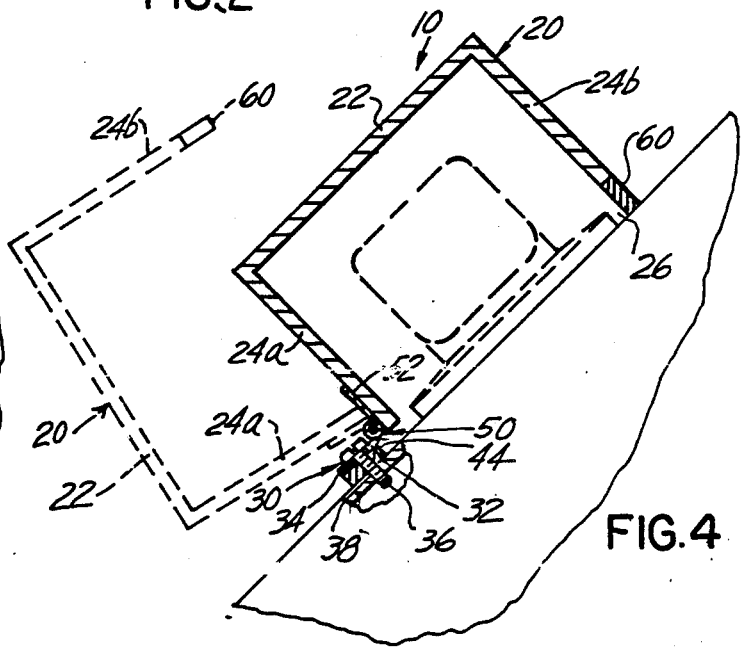
FIG. 4

PROTECTIVE COVERING DEVICE

BACKGROUND AND SUMMARY OF THE INVENTION

This invention generally relates to devices, covers, lids, et cetera for protectively covering control knobs which are typically positioned on appliances such as stoves and ovens.

Personal experience and we believe the experience of the population at large indicates that younger children by having uncontrolled access to the control knobs of stoves and/or ovens cause damage to themselves and to property in general. With hardly any effort a younger child can activate the control knob thereby causing the top burner of the appliance to become hot. With regard to gas appliances having automatic pilot lights, the activation of the control knob will produce a flame which can cause immediate harm to the child. In electric appliances there is a time lag between the time that the control knob is activated and when the cooking surface becomes hot but still this represents a significant potential for injury to the child. It is not uncommon for the younger child to first play with the control knob thereby activating the cooking surface and to later climb upon the cooking surface of the stove, forgetting about the heated surface resulting in serious injury to the child. In addition, an unattended heated cooking surface can result in fire and serious property damage.

It is an object of the present invention to provide a protective device for the various control knobs on an appliance which will deter younger children from purposely or inadvertently activating the control knob. A further purpose of the present invention is to provide a protective device which can be moved off from the control knob to permit proper access thereto.

Accordingly, the invention comprises: a protective device useful with an appliance such as a stove or an oven having at least one control knob operatively positioned on a a first surface of the appliance, the device comprising: first means, movable between a first position and a second position, for protectively enveloping the control knob when in the first position and for permitting access to the control knob when in the second position; and second means for causing the first means to tend to be maintained in the first position.

Many other objects and purposes of the invention will be clear from the following detailed description of the drawings.

BRIEF DESCRIPTION OF THE DRAWINGS

In the Drawings:

FIG. 1 illustrates a cover protectively enclosing a plurality of control knobs.

FIG. 2 illustrates a front view of the protective cover.

FIG. 3 illustrates a right side view of the cover, and

FIG. 4 illustrates another view of the cover in its protective position and by way of the dotted lines illustrates the protective cover moved to another position to permit access to the control knobs.

FIG. 5 shows another embodiment of the invention.

DETAILED DESCRIPTION OF THE DRAWINGS

FIG. 1 illustrates a protective device 10 especially useful with an appliance 12 such as a stove or an oven having a plurality of control knobs 14*a*–14*n*. The device comprises a cover or lid 20 moveable between a first position as illustrated in FIGS. 1 and 3 for protectively enclosing the control knobs, to a second position (illustrated in FIG. 4) for permitting access thereto.

As illustrated in the FIGURES, the cover 20 comprises a generally rectangular structure including a top 22 and opposing sides 24*a* and *b*. The top and sides cooperate to define a generally open bottom 26. The ends 28*a* and *b* of the cover 20 may be open or closed as the specific application dictates. The protective device further includes a member 30 adapted to be physically attached to the appliance 12. More specifically, this member 30 may include an extending member 32, such as a rectangular bar, which may include a plurality of openings 34 to receive fasteners such as screws 36. Once mounted to the appliance 12 the fasteners extend through holes 38 formed in a cooperating surface thereof. The device may optionally include a strip of thermal insulating material 44 positioned below the extending member 32. Noninvasive methods of mounting the cover 20 are also within the scope of the present invention. As an example, a replacement for the screws can be obtained by employing a magnetic strip below the member 32. Further, the insulative material 44 can be magnetic and function as both a means for attaching and means for insulating.

The member 32 and one of the sides, such as side 24*a* of the cover 20 are rotatably coupled coupled one to the other. Means for achieving this rotary coupling can be accomplished in a variety of ways. As an example, a hinge 50, having an elongated first first portion 52 can be fastened, by known methods, to the side 24*a*. A hinge 50 will typically have a second elongated portion which in the embodiment shown is the first member 32. Alternatively, the hinge 50 may be formed integrally with the lower portion of the side 24*a* and the first member 32. Further, if the cover is fabricated of a flexible material such as plastic it is within the scope of the present invention that the member 32, cover 20 and hinge 50 therebetween form what is known in the art as a living hinge of integral construction.

The device 10 further includes a mechanism which in cooperation with the remaining parts of the cover 20 will permit the cover 20 to be maintained in a first position to protectively envelop the control knobs. As illustrated in the FIGURES, this mechanism may include a strip of magnetic material 60 affixed to the lower portion of the opposite side 24*b*. In this manner, when the cover 20 is rotated, by the user, towards a metal surface of the appliance, the magnetic material will engage such surface thereby maintaining the cover in the orientation as illustrated in the FIGURES. When access to a control knob or knobs is desired, the user will rotate the cover away from the surfaces of the appliance to the position illustrated by the phantom lines of FIG. 4.

An alternate embodiment of the invention may be obtained by using another magnetic strip (see FIG. 5) separate from the side 24*b*. In this manner this separate magnetic strip may be placed upon the appliance 12 such that when the cover 20 is moved to the first position the magnetic strip will maintain the cover in place. A still further embodiment of the invention can be achieved by not employing the magnetic material 60, as shown in the FIGURES and replacing means with a resilient element 62 to provide a force biasing the cover 20 toward the first position. Once such resilient element may include spring 64 or plurality of springs operative about the hinge 50.

With reference to FIG. 1, the cover 20 illustrated is of unitary construction which when rotated to the second position provides access to all of the control knobs 14. FIG. 2 suggests, by the phantom lines 20*a* and *b*, an alternate embodiment of the invention wherein the cover 20 can be divided into two or more sections (20*a*, *b*) to selectively permit access to particular control knobs or a particular set of control knobs. In this case the various sections could be separately hinged and use separate strips of magnetic material 60 or springs 64.

Many changes and modifications in the above described embodiment of the invention can, of course, be carried out without departing from the scope thereof. Accordingly, that scope is intended to be limited only by the scope of the appended claims.

We claim:

1. A device useful for covering a control knob of an appliance comprising:

a generally rectangular cover including two opposing sides defining an opening therebetween for enveloping the control knob when mated to the appliance, the end of one side being ferromagnetic;

magnetic material fixed to the appliance at a location to magnetically engage the end of the one side when such side is positioned thereto;

means for attaching the other side to the appliance.

2. The device as defined in claim 1 wherein the magnetic material is a strip of magnetic material extending along the direction of the one side.

3. The device as defined in claim 2 wherein the magnetic material is fabricated of a material having a low thermal conductivity to act of a thermal insulator.

4. The device as defined in claim 1 wherein the means for attaching includes a second magnetic material fixed to the appliance and wherein the end of the other side is ferromagnetic.

5. The device as defined on claim 4 wherein the second ferromagnetic material is a strip of magnetic material extending along the direction of the other side.

6. The device as defined in claim 4 wherein the ferromagnetic end of the other side is formed as a hinge which is secured to the appliance via interaction with the second magnetic material.

7. The device as defined in claim 6 wherein the second material extends along the direction of the hinge.

8. The device as defined in claim 5 wherein the second magnetic material is fabricated of a material having a low thermal conductivity to act of a thermal insulator.

9. The device as defined in claim 6 wherein the hinge is a spring hinge.

10. The device as defined in claim 1 wherein the attaching means comprises a hinge formed at the end of the other side and including means for permanently attaching the hinge to the appliance.

11. The device as defined in claim 10 wherein the permanent attaching means in one of: rivets, screws, bolts and weldments.

12. The device as defined in claim 10 wherein the hinge is a spring hinge.

* * * * *